US009525241B1

(12) United States Patent
Su et al.

(10) Patent No.: US 9,525,241 B1
(45) Date of Patent: Dec. 20, 2016

(54) ELECTRICAL CONNECTOR

(71) Applicant: Cheng Uei Precision Industry Co., Ltd., New Taipei (TW)

(72) Inventors: Yu-Hung Su, New Taipei (TW); Chin-Chou Wang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/980,463

(22) Filed: Dec. 28, 2015

(51) Int. Cl.

| | |
|---|---|
| ***H01R 13/648*** | (2006.01) |
| ***H01R 13/6581*** | (2011.01) |
| ***H01R 13/62*** | (2006.01) |
| ***H01R 24/68*** | (2011.01) |
| ***H01R 13/6597*** | (2011.01) |

(52) U.S. Cl.
CPC ..... *H01R 13/6581* (2013.01); *H01R 13/62* (2013.01); *H01R 13/6597* (2013.01); *H01R 24/68* (2013.01)

(58) Field of Classification Search
CPC ..... H01R 13/514; H01R 13/6586; H01R 13/6587; H01R 13/6593; H01R 13/6594; H01R 13/6597; H01R 23/02; H01R 23/688; H01R 24/60; H01R 13/6585
USPC ..... 439/607.23, 607.05, 607.11, 607.34, 439/607.35, 607.55, 660, 701
See application file for complete search history.

(56) References Cited

U.S. PATENT DOCUMENTS

| | | | | |
|---|---|---|---|---|
| 7,758,379 | B2 * | 7/2010 | Chen | H01R 13/6485 439/607.11 |
| 8,262,411 | B2 * | 9/2012 | Kondo | H01R 13/6658 439/607.01 |
| 8,808,029 | B2 * | 8/2014 | Castillo | H01R 13/6585 439/607.05 |
| 9,022,800 | B2 * | 5/2015 | Yang | H01R 13/6581 439/487 |
| 9,178,319 | B2 * | 11/2015 | Little | H01R 13/6585 |
| 9,252,542 | B2 * | 2/2016 | Little | H01R 13/6585 |
| 9,281,643 | B1 * | 3/2016 | Tseng | H01R 13/518 |
| 9,337,585 | B1 * | 5/2016 | Yang | H01R 13/6583 |
| 2014/0194005 | A1 * | 7/2014 | Little | H01R 13/6585 439/607.28 |
| 2015/0255905 | A1 * | 9/2015 | Little | H01R 13/6658 439/78 |
| 2015/0372424 | A1 * | 12/2015 | Little | H01R 13/642 439/217 |
| 2016/0043511 | A1 * | 2/2016 | Hsu | H01R 13/6585 439/607.05 |

(Continued)

*Primary Examiner* — Tulsidas C Patel
*Assistant Examiner* — Travis Chambers
(74) *Attorney, Agent, or Firm* — Cheng-Ju Chiang

(57) ABSTRACT

An electrical connector includes a middle shielding plate, a lower terminal module, an upper terminal module mounted on a top surface of the middle shielding plate, an insulation module and a shielding shell. The middle shielding plate is mounted on the lower terminal module. The lower terminal module includes a plurality of lower terminals which include two lower ground terminals. A front end of an outer side of each of the lower ground terminals is connected with a lower connecting piece. The upper terminal module includes a plurality of upper terminals which include two upper ground terminals. A front end of an outer side of each of the upper ground terminals is connected with an upper connecting piece. The shielding shell is mounted outside the lower terminal module, the upper terminal module and the insulation module.

18 Claims, 11 Drawing Sheets

(56) References Cited

U.S. PATENT DOCUMENTS

| | | | | |
|---|---|---|---|---|
| 2016/0118752 | A1* | 4/2016 | Guo | H01R 13/6594<br>439/78 |
| 2016/0149350 | A1* | 5/2016 | Kao | H01R 13/6585<br>439/607.05 |

* cited by examiner

ELECTRICAL CONNECTOR

BACKGROUND OF THE INVENTION

1. Field of the Invention

The present invention generally relates to a connector, and more particularly to an electrical connector capable of realizing a normal insertion and a reverse insertion.

2. The Related Art

With the development of electronic industries, a conventional USB 2.0 electrical connector needs to be distinguished an obverse surface from a reverse surface to be inserted and a drawback of a lower transmission speed is gradually emerged. The conventional USB 2.0 electrical connector includes an insulating housing and a plurality of first terminals. The insulating housing has a base portion and a tongue board protruded frontward from a front surface of the base portion. The first terminals are fastened to the insulating housing with front ends of the first terminals being exposed to a top surface of the tongue board. In order to realize a normal insertion and a reverse insertion of the USB 2.0 electrical connector, a plurality of second terminals are increased to be fastened to the insulating housing of the USB 2.0 electrical connector with front ends of the second terminals being exposed to a bottom surface of the tongue board. But the above-mentioned structure will cause a series of problems, especially, electromagnetic interferences will be generated between the first terminals and the second terminals to affect signal transmission qualities of the first terminals and the second terminals.

In order to reduce the electromagnetic interferences between the first terminals and the second terminals, a USB 3.1 electrical connector generally includes an insulating housing, a plurality of upper terminals, a plurality of lower terminals, and a shielding plate mounted between the upper terminals and the lower terminals to improve an electromagnetic shielding effect so as to improve signal transmission qualities of the upper terminals and the lower terminals. However, the USB 3.1 connector has no way of completely shielding all electromagnetic interferences, a high-frequency transmission waveform will be usually unstable, in addition, rear ends of the upper terminals and rear ends of the lower terminals are exposed outside to be affected by external electromagnetic interferences, so that signal transmission qualities of the upper terminals and the lower terminals are lowered.

Thus, in order to effectively overcome the aforesaid drawbacks, an innovative electrical connector is essential to be provided, a high-frequency transmission wave form of the innovative electrical connector is steady, and transmission qualities of electrical signals of the innovative electrical connector are improved, so that the innovative electrical connector is convenient for a user to be used.

SUMMARY OF THE INVENTION

An object of the present invention is to provide an electrical connector mounted to a circuit board. The electrical connector includes a middle shielding plate, a lower terminal module, an upper terminal module, an insulation module and a shielding shell. The middle shielding plate has a restricting plate and a soldering arm connected with the restricting plate, the soldering arm being soldered on a top surface of the circuit board. The middle shielding plate is mounted on the lower terminal module. The lower terminal module includes a lower insulating housing and a plurality of lower terminals. The lower terminals are fixed to the lower insulating housing and are transversely arranged at intervals. Front ends of the lower terminals project beyond a front surface of the lower insulating housing. Rear ends of the lower terminals project beyond a bottom surface of the lower insulating housing and are soldered on the top surface of the circuit board. The lower terminals include two lower ground terminals. A front end of an outer side of each of the lower ground terminals is connected with a lower connecting piece. The lower connecting piece contacts with a bottom surface of the middle shielding plate. The upper terminal module is mounted on a top surface of the middle shielding plate. The upper terminal module includes an upper insulating housing and a plurality of upper terminals. The upper terminals are fixed to the upper insulating housing and are transversely arranged at intervals. Front ends of the upper terminals project beyond a front surface of the upper insulating housing. Rear ends of the upper terminals project beyond a bottom surface of the upper insulating housing and are soldered on the top surface of the circuit board. The upper terminals include two upper ground terminals. A front end of an outer side of each of the upper ground terminals is connected with an upper connecting piece. The upper connecting piece contacts with a top surface of the middle shielding plate. The insulation module includes a tongue board and a main body. The tongue board is molded to front ends of the lower terminal module. The upper terminal module and the middle shielding plate, the front ends of the lower terminals are exposed to a bottom surface of the tongue board. The front ends of the upper terminals are exposed to a top surface of the tongue board. The main body is molded outside the tongue board, the middle shielding plate, the lower terminal module and the upper terminal module. The shielding shell is mounted outside the lower terminal module, the upper terminal module and the insulation module. An insertion space is formed between a front end of the shielding shell and the insulation module.

As described above, the lower connecting piece of each of the lower ground terminals contacts with the bottom surface of the middle shielding plate, and the upper connecting piece of each of the upper ground terminals contacts with the top surface of the middle shielding plate, electromagnetic interferences will be effectively eliminated between the lower terminals and the upper terminals to improve signal transmission qualities of the lower terminals and the upper terminals. In addition, the outer shell is mounted outside and seals up the front end of the main shell, the propping plate of the bottom shell is disposed under a lower base portion of the lower insulating housing, an upper soldering portion of each of the upper terminals and a lower soldering portion of each of the lower terminals, so the lower terminals and the upper terminals are surrounded by the shielding shell to effectively avoid external electromagnetic interferences, so that the signal transmission qualities of the lower terminals and the upper terminals are further improved.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
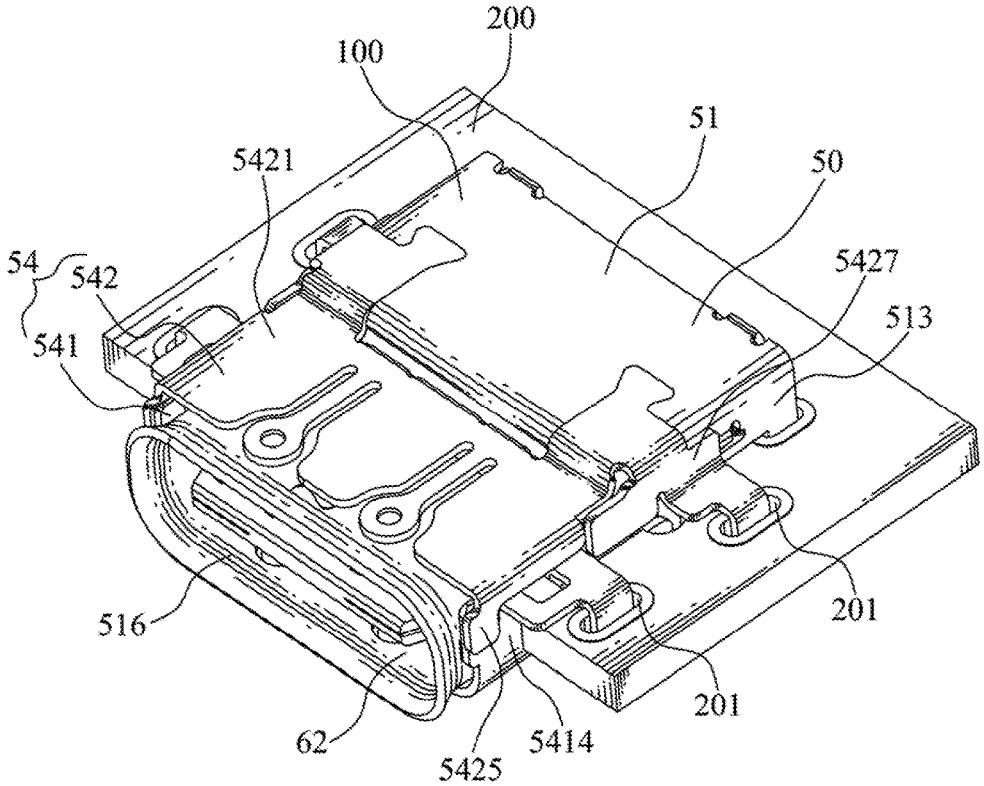
FIG. 1 is a perspective view showing that an electrical connector in accordance with the present invention is mounted to a circuit board.
Figure 2:
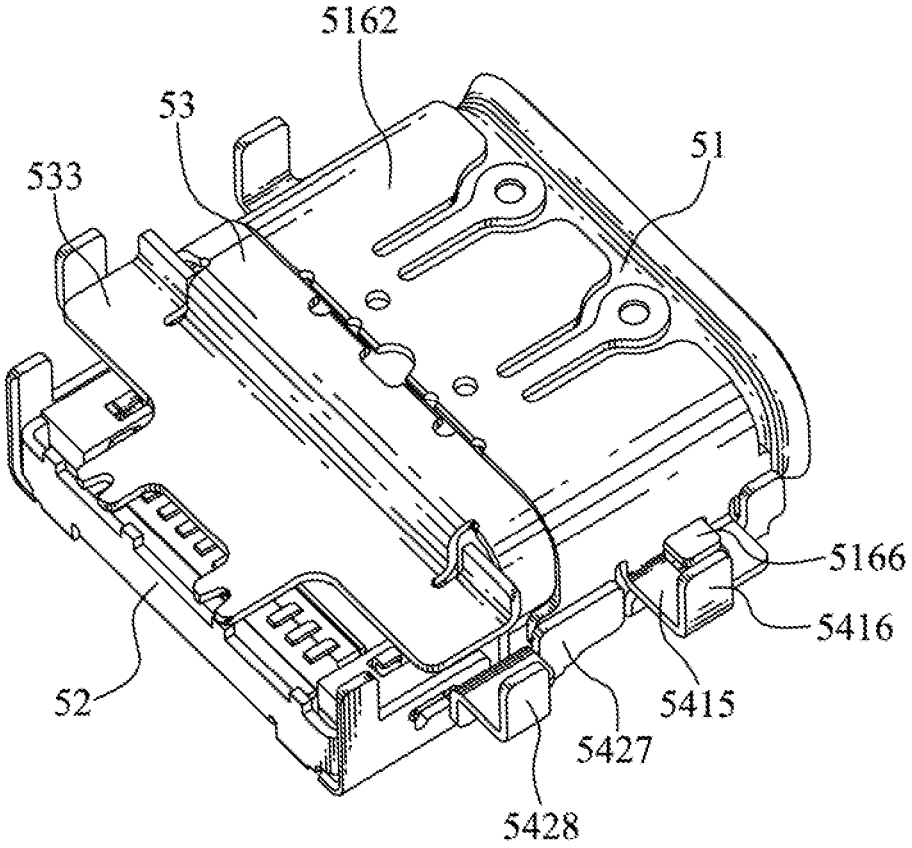
FIG. 2 is another perspective view of the electrical connector of FIG. 1.
Figure 3:
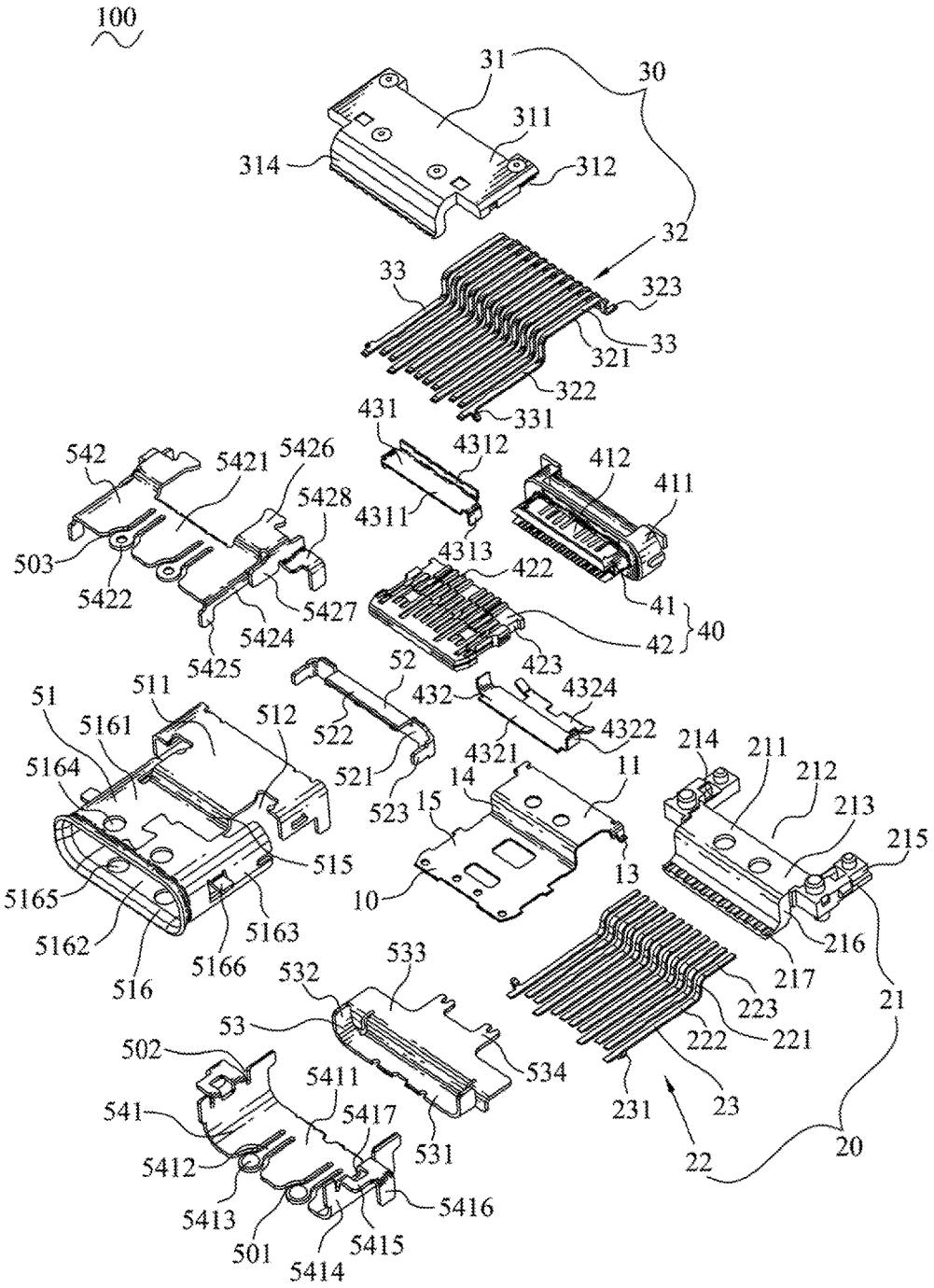
FIG. 3 is an exploded view of the electrical connector of FIG. 1.

With reference to FIG. 1 and FIG. 3, an electrical connector 100 in accordance with the present invention is shown. The electrical connector 100 mounted to a circuit board 200, includes a middle shielding plate 10, a lower terminal module 20, an upper terminal module 30, an insulation module 40 and a shielding shell 50.

Figure 4:
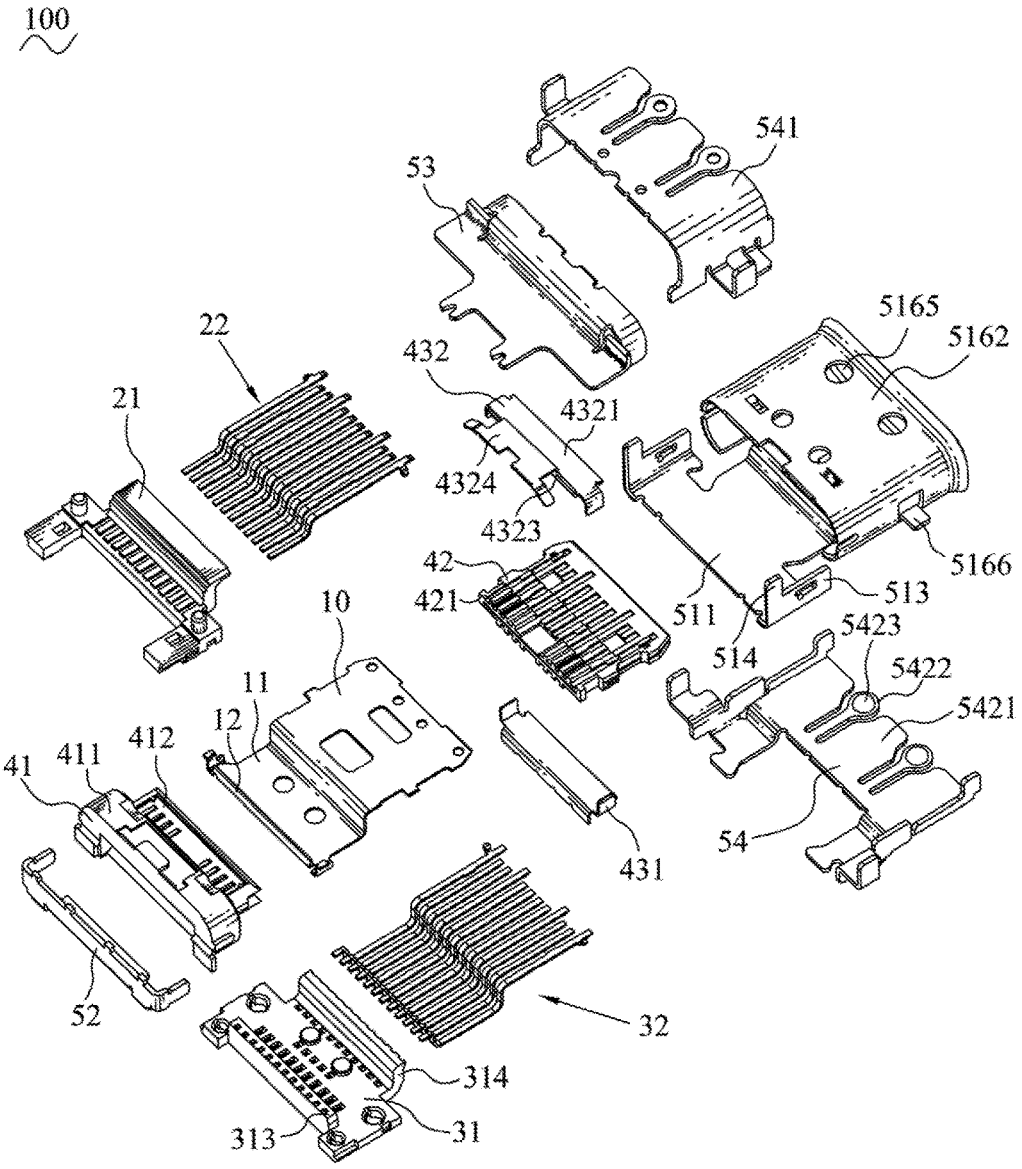
FIG. 4 is another exploded view of the electrical connector of FIG. 1.

Referring to FIG. 3 and FIG. 4, the middle shielding plate 10 has a restricting plate 11, an abutting plate 12 bent downward from a rear end of the restricting plate 11, and a soldering arm 13 connected with the restricting plate 11. Rear ends of two opposite sides of the restricting plate 11 are bent downward and then are bent outward to form two soldering arms 13. A front end of the restricting plate 11 is bent downward to form a front plate 14. A bottom end of the front plate 14 is bent frontward and further extends frontward to form a tongue plate 15.

Figure 5:
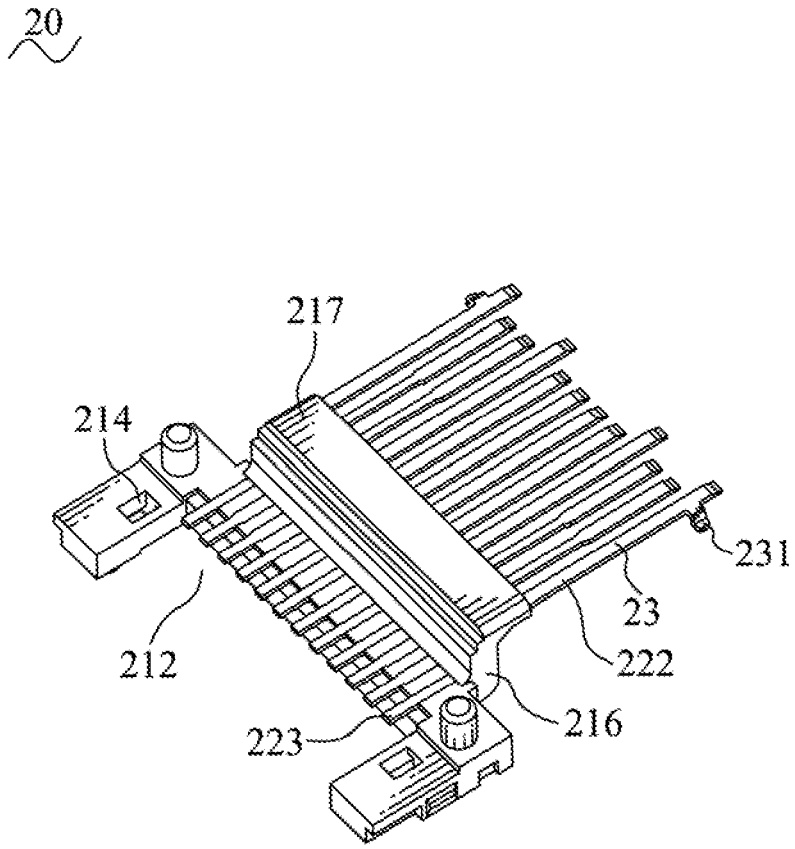
FIG. 5 is a perspective view of a lower terminal module of the electrical connector of FIG. 4.

Referring to FIG. 3 and FIG. 5, the lower terminal module 20 includes a lower insulating housing 21 and a plurality of lower terminals 22. The lower insulating housing 21 has a lower base portion 211. The lower base portion 211 defines a receiving opening 212 penetrating through rear ends of a top surface, a bottom surface and a middle of a rear surface of the lower base portion 211. A front end of the top surface of the lower base portion 211 is recessed downward to form an assembling opening 213 communicated with the receiving opening 212. The lower base portion 211 defines two assembling holes 214 respectively penetrating through two opposite sides of the top surface and two opposite sides of the bottom surface of the lower base portion 211. The two assembling holes 214 are located at two opposite sides of the receiving opening 212. Upper portions of two opposite side surfaces of the lower base portion 211 are recessed inward to form two first recesses 215. A front end of the bottom surface of the lower base portion 211 extends downward to form a connecting board 216. A bottom of a front surface of the connecting board 216 extends frontward to form an extending board 217.

The lower terminals 22 are fixed to the lower insulating housing 21 and are transversely arranged at intervals. Front ends of the lower terminals 22 project beyond a front surface of the lower insulating housing 21. Rear ends of the lower terminals 22 project beyond a bottom surface of the lower insulating housing 21 and are soldered to the circuit board 200. Each of the lower terminals 22 has an elongated lower fastening portion 221 extending in a substantially vertical direction, a lower contact portion 222 extended frontward from a bottom of the lower fastening portion 221, and a lower soldering portion 223 extended rearward from a top of the lower fastening portion 221. Specifically, the lower terminals 22 include two lower ground terminals 23. The two lower ground terminals 23 are respectively fastened to two opposite sides of the lower insulating housing 21. A front end of an outer side of each of the two lower ground terminals 23 is connected with a lower connecting piece 231. The front end of the outer side of each of the lower ground terminals 23 extends upward and then extends outward to form the lower connecting piece 231. A front end of an outer side of the lower contact portion 222 of each of the lower ground terminals 23 extends upward and then extends outward to form the lower connecting piece 231.

The lower fastening portion 221 of each of the lower terminals 22 is fastened in the connecting board 216. A rear end of the lower contact portion 222 of each of the lower terminals 22 is fastened in the extending board 217. A front end of the lower contact portion 222 of each of the lower terminals 22 projects beyond a front surface of the extending board 217. A front end of the lower soldering portion 223 of each of the lower terminals 22 is fastened to the bottom surface of the lower base portion 211. A tail end of the lower soldering portion 223 projects into the receiving opening 212.

Figure 6:
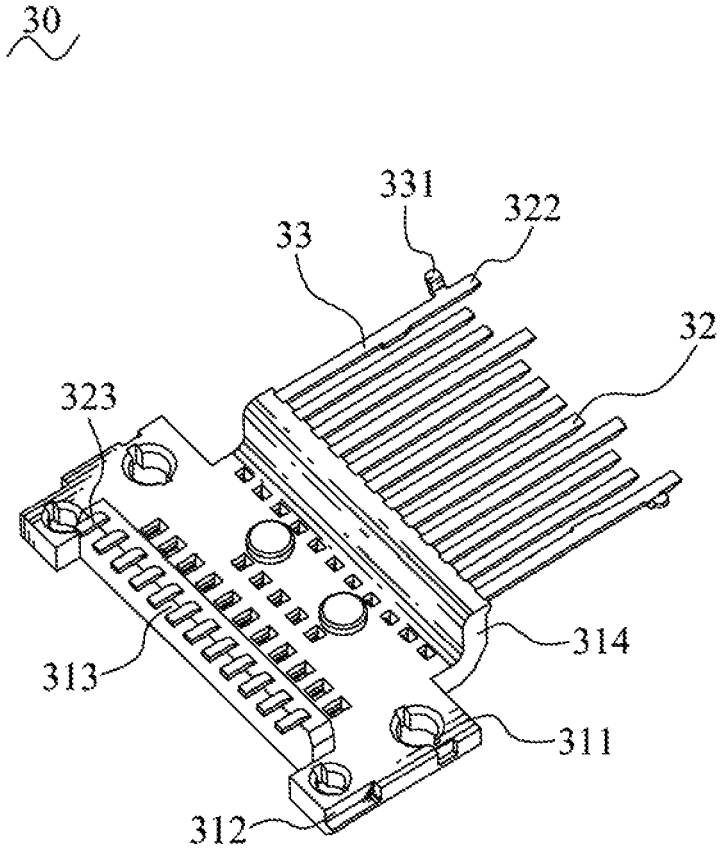
FIG. 6 is a perspective view of an upper terminal module of the electrical connector of FIG. 4.
Figure 7:
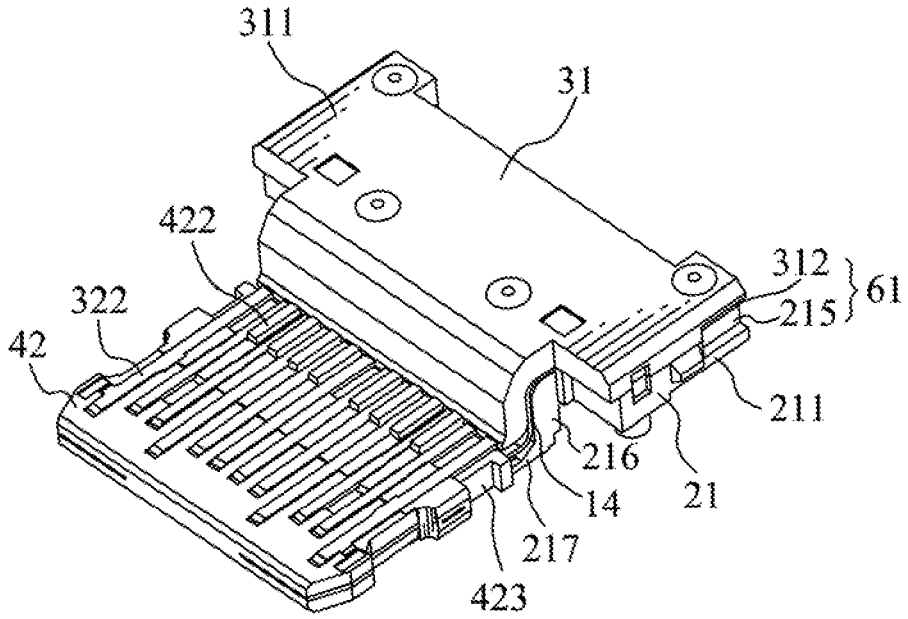
FIG. 7 is a perspective view showing that a tongue portion is molded to the lower terminal module, the upper terminal module and a middle shielding plate of the electrical connector of FIG. 4.
Figure 8:
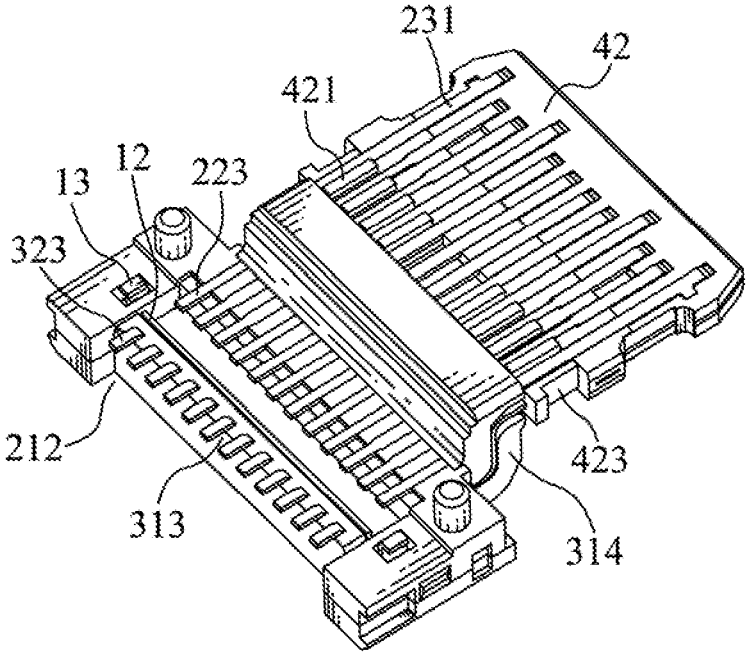
FIG. 8 is another perspective view showing that the tongue portion is molded to the lower terminal module, the upper terminal module and the middle shielding plate of the electrical connector of FIG. 4.

Referring to FIG. 3, FIG. 4 and FIG. 6, the upper terminal module 30 includes an upper insulating housing 31 and a plurality of upper terminals 32. The upper insulating housing 31 has an upper base portion 311. Bottoms of two opposite side surfaces of the upper base portion 311 are recessed inward to form two second recesses 312. A rear end of a bottom surface of the upper base portion 311 protrudes downward to form an upper protruding board 313 extending transversely. A front end of the bottom surface of the upper base portion 311 protrudes downward to form an upper fastening board 314 extending transversely.

The upper terminals 32 are fixed to the upper insulating housing 31 and are transversely arranged at intervals. Front ends of the upper terminals 32 project beyond a front surface of the upper insulating housing 31. Rear ends of the upper terminals 32 project beyond a bottom surface of the upper insulating housing 31 and are soldered to the circuit board 200. Each of the upper terminals 32 has an inverted U-shaped upper fastening portion 321, an upper contact portion 322 extended frontward from a bottom of a front end of the upper fastening portion 321, and an upper soldering portion 323 extended rearward from a bottom of a rear end of the upper fastening portion 321. Specifically, the upper terminals 32 include two upper ground terminals 33. The two upper ground terminals 33 are respectively fastened to two opposite sides of the upper insulating housing 31. A front end of an outer side of each of the two upper ground terminals 33 is connected with an upper connecting piece 331. The front end of the outer side of each of the upper ground terminals 33 extends upward and then extends outward to form the upper connecting piece 331. A front end of an outer side of the upper contact portion 322 of each of the upper ground terminals 33 extends downward and then extends outward to form the upper connecting piece 331.

The upper fastening portion 321 is fastened in the upper base portion 311, the upper protruding board 313 and the upper fastening board 314. The upper contact portion 322 projects beyond a bottom of a front surface of the upper fastening board 314. The upper soldering portion 323 projects beyond a bottom surface of the upper protruding board 313.

Figure 9:
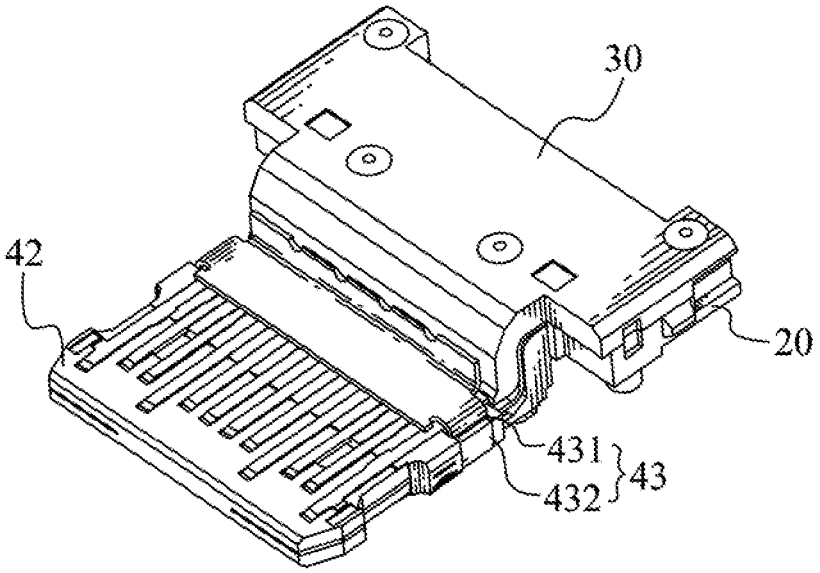
FIG. 9 is a partially perspective view showing that the electrical connector in accordance with the present invention is without a shielding shell and a main body.
Figure 10:
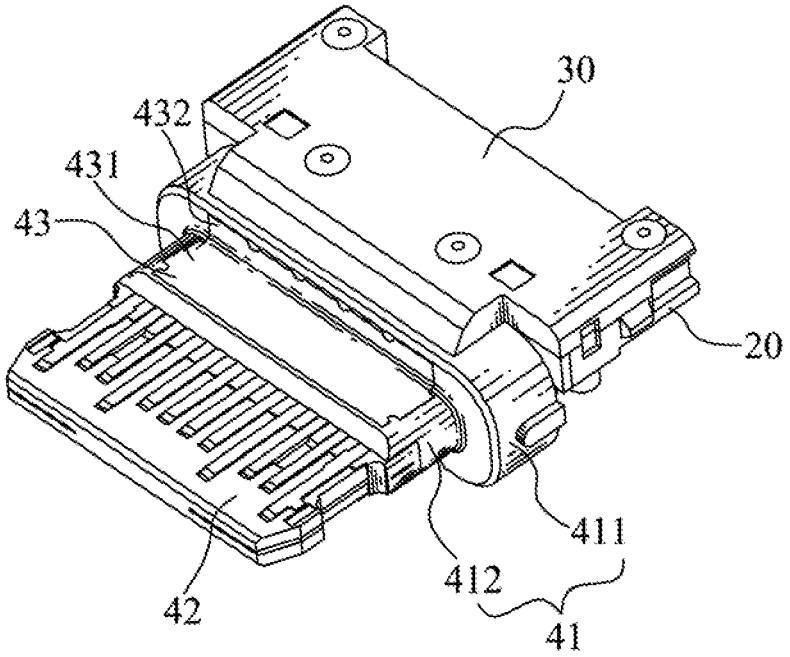
FIG. 10 is a partially perspective view showing that the electrical connector in accordance with the present invention is without the shielding shell.
Figure 11:
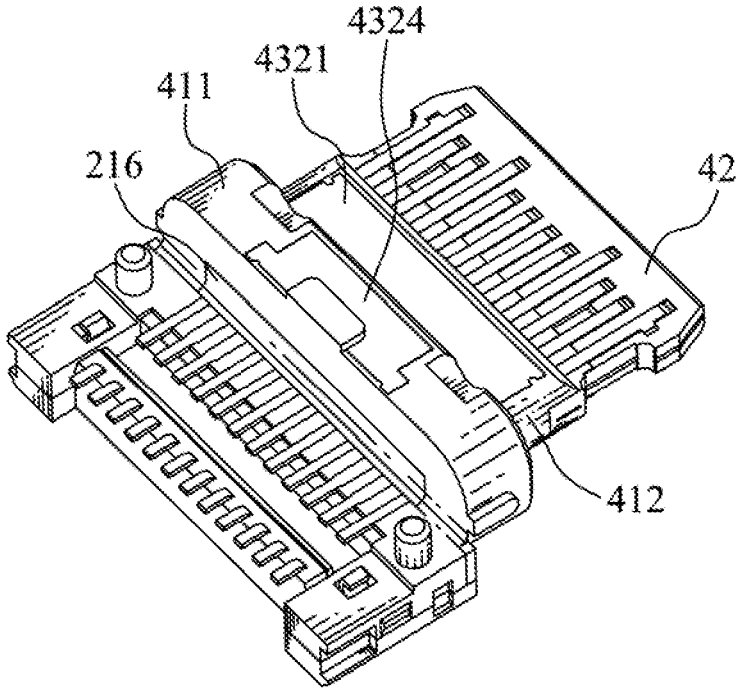
FIG. 11 is another partially perspective view showing that the electrical connector in accordance with the present invention is without the shielding shell.

Referring to FIG. 3, FIG. 4 and FIG. 9, the insulation module 40 includes a main body 41, a tongue board 42 and a metal shell 43. The main body 41 has a dielectric body 411, and a butting portion 412 protruded frontward from a middle of a front surface of the dielectric body 411. Several portions of a rear end of a bottom surface of the tongue board 42 protrude downward to form a plurality of spaced lower protruding blocks 421 arranged transversely. Several portions of a rear end of a top surface of the tongue board 42 protrude upward to form a plurality of spaced upper protruding blocks 422 arranged transversely. Two opposite sides of a rear end of the tongue board 42 are recessed inward to form two fastening grooves 423.

The metal shell 43 includes an upper shell 431 and a lower shell 432. The upper shell 431 has an upper base plate 4311, an upper rear plate 4312 bent upward from a rear end of the upper base plate 4311, and two upper side plates 4313 bent downward from two opposite sides of the upper base plate 4311. The lower shell 432 has a lower base plate 4321, two lower side plates 4322 bent upward from two opposite sides of the lower base plate 4321, a lower rear plate 4323 bent downward from a rear end of the lower base plate 4321, and an embedding plate 4324 extended rearward from a bottom edge of the lower rear plate 4323.

Referring to FIG. 1 to FIG. 4, the shielding shell 50 includes a main shell 51, a rear shell 52, a bottom shell 53 and an outer shell 54. The main shell 51 has a bottom plate 5162, two connecting plates 5163 bent upward from two opposite sides of the bottom plate 5162, a top plate 5161 connected between fronts of top edges of the two connecting plates 5163, and a receiving space 516 formed among the top plate 5161, the bottom plate 5162 and the connecting plates 5163. A middle of a rear edge of the top plate 5161 of the main shell 51 is bent upward to form a connecting slice 515. A top edge of the connecting slice 515 extends rearward and then spreads outward to form a fastening plate 511. The fastening plate 511 has a longitudinal plate 5111 and a transverse plate 5112. The longitudinal plate 5111 is connected with the top edge of the connecting slice 515. A middle of a front edge of the transverse plate 5112 is connected with a rear edge of the longitudinal plate 5111. Two opposite sides of the front edge of the transverse plate 5112 are recessed rearward to form two notches 512. Two opposite sides of the transverse plate 5112 are bent downward to form two lateral plates 513. Rears of bottom edges of the two lateral plates 513 protrude downward to form two insertion feet 514. The top plate 5161 of the main shell 51 defines at least two upper fastening holes 5164 arranged transversely. The bottom plate 5162 of the main shell 51 defines at least two lower fastening holes 5165 arranged transversely. The two connecting plates 5163 of the main shell 51 are punched outward to form two propping pieces 5166.

The rear shell 52 has a blocking plate 521. A middle of a top edge of the blocking plate 521 is bent frontward to form a first fixing plate 522. Two opposite sides of the blocking plate 521 are bent frontward to form two first fixing arms 523. The bottom shell 53 has a second fixing plate 531. Two opposite sides of a front end of the second fixing plate 531 of the bottom shell 53 are bent upward to form two second fixing arms 532. A rear end of the second fixing plate 531 is bent upward and then is bent rearward to form a propping plate 533. Two opposite sides of a rear edge of the propping plate 533 extend rearward to form two soldering feet 534.

The outer shell 54 includes a first outer shell 541 and a second outer shell 542. The first outer shell 541 has a first locating plate 5411. The first locating plate 5411 defines at least two first gaps 501 penetrating through a front surface of the first locating plate 5411. Rear walls of the two first gaps 501 extend frontward to form two first elastic portions 5412. Free ends of the two first elastic portions 5412 are punched upward to form two first protruding portions 5413. Two opposite sides of the first locating plate 5411 are bent upward to form two first holding plates 5414. Top ends of the first holding plates 5414 define two second gaps 502. Bottom walls of the two second gaps 502 extend upward and then are bent outward to form two connecting arms 5415. Rears of outer sides of the two connecting arms 5415 of the first outer shell 541 are bent downward to form two first insertion slices 5416. The two connecting arms 5415 define two buckling holes 5417.

The second outer shell 542 has a second locating plate 5421. The second locating plate 5421 defines at least two third gaps 503 penetrating through a front surface of the second locating plate 5421. Rear walls of the two third gaps 503 extend frontward to form two second elastic portions 5422. Free ends of the two second elastic portions 5422 are punched downward to form two second protruding portions 5423. Two opposite sides of the second locating plate 5421 are bent downward to form two second holding plates 5424. Fronts of bottom edges of the two second holding plates 5424 protrude downward to form two soldering slices 5425. Two opposite sides of a rear edge of the second locating plate 5421 are bent upward and then extend rearward to form two sealing pieces 5426. Two outer sides of the two sealing pieces 5426 are bent downward to form two third holding plates 5427. Rears of bottom edges of the two third holding plates 5427 are bent outward and then are bent downward to form two second insertion slices 5428.

Referring to FIG. 1 to FIG. 11, when the electrical connector 100 is assembled, the middle shielding plate 10 is mounted on the lower terminal module 20. The lower connecting piece 231 of each of the lower ground terminals 23 contacts with a bottom surface of the middle shielding plate 10. Specifically, the lower soldering portion 223 of each of the lower terminals 22 is soldered on a top surface of the circuit board 200. A front end of the restricting plate 11 is assembled in the assembling opening 213. A rear end of the restricting plate 11 is located above the receiving opening 212. The abutting plate 12 projects into the receiving opening 212. The front plate 14 abuts against the front surface of the connecting board 216. A rear end of the tongue plate 15 is disposed above the extending board 217. The lower connecting piece 231 of each of the two lower ground terminals 23 contacts with a bottom surface of the tongue plate 15. The two soldering arms 13 are fastened to the two assembling holes 214 and project beyond the bottom surface of the lower base portion 211. The two soldering arms 13 are soldered on the top surface of the circuit board 200.

The upper terminal module 30 is mounted on a top surface of the middle shielding plate 10. The upper connecting piece 331 of each of the upper ground terminals 33 contacts with the top surface of the middle shielding plate 10. The electrical connector 100 is capable of realizing a normal insertion and a reverse insertion. Specifically, the upper base portion 311 is fastened on top surfaces of the lower base portion 211 and the restricting plate 11. Two opposite sides of a rear surface of the upper base portion 311 is flush with two opposite sides of a rear surface of the lower base portion 211. The front surface of the upper fastening board 314 is flush with the front surface of the extending board 217. The two first recesses 215 are respectively corresponding to and cooperate with the two second recesses 312 to form two fixing grooves 61. The upper protruding board 313 projects into the receiving opening 212. A front surface of the upper protruding board 313 is located behind a rear surface of the abutting plate 12. The upper soldering portion 323 of each of the upper terminals 32 is received in a bottom of a rear of the receiving opening 212 and is soldered on the top surface of the circuit board 200. A rear surface of the upper fastening board 314 abuts against a front surface of the front plate 14. The upper connecting piece 331 of each of the upper ground terminals 33 contacts with a top surface of the tongue plate 15.

The tongue board 42 is molded to front ends of the lower terminal module 20, the upper terminal module 30 and the middle shielding plate 10. The front ends of the lower terminals 22 are exposed to a bottom surface of the tongue board 42. The front ends of the upper terminals 32 are exposed to a top surface of the tongue board 42. Specifically, the tongue board 42 is molded to the lower contact portion 222 of each of the lower terminals 22, the upper contact portion 322 of each of the upper terminals 32 and a front end of the tongue plate 15. Two opposite side surfaces of the front end of the tongue plate 15 are exposed to two opposite side surfaces of the tongue board 42. The lower contact portion 222 of each of the lower terminals 22 is exposed to the bottom surface of the tongue board 42. The upper contact portion 322 of each of the upper terminals 32 is exposed to the top surface of the tongue board 42.

The metal shell 43 is fastened to a rear end of the tongue board 42. Specifically, the upper base plate 4311 is disposed on top surfaces of the upper protruding blocks 422. The two upper side plates 4313 are respectively fastened in the two fastening grooves 423. The lower base plate 4321 is disposed at bottom surfaces of the lower protruding blocks 421. The two lower side plates 4322 are respectively soldered to outer surfaces of the two upper side plates 4313.

The main body 41 is molded outside the tongue board 42, the metal shell 43, the middle shielding plate 10, the lower terminal module 20 and the upper terminal module 30. Specifically, the main body 41 is molded outside the rear end of the tongue board 42, the metal shell 43, substantially middles of the middle shielding plate 10, the lower terminal module 20 and the upper terminal module 30. The dielectric body 411 is molded outside the upper fastening board 314, the connecting board 216 and the extending board 217. A rear surface of the connecting board 216 is flush with a rear surface of the main body 41. The butting portion 412 is molded outside the rear end of the tongue board 42 and the metal shell 43. A bottom surface of the lower base plate 4321 is flush with and exposed to a bottom surface of the butting portion 412. A front surface of the lower rear plate 4323 is flush with the front surface of the dielectric body 411 and is exposed to a lower portion of the front surface of the dielectric body 411. A bottom surface of the embedding plate 4324 is flush with and exposed to a bottom surface of the dielectric body 411. A top surface of the upper base plate 4311 is flush with and exposed to a top surface of the butting portion 412. A front surface of the upper rear plate 4312 is flush with the front surface of the dielectric body 411 and exposed to an upper portion of the front surface of the dielectric body 411.

The shielding shell 50 is mounted outside the lower terminal module 20, the upper terminal module 30 and the insulation module 40. An insertion space 62 is formed between a front end of the shielding shell 50 and the insulation module 40. Specifically, the blocking plate 521 is disposed behind the upper base portion 311 and the lower base portion 211. The first fixing arms 523 are fixed in the fixing grooves 61. The first fixing plate 522 is received in a rear of receiving opening 212 and is located above the upper soldering portion 323 of each of the upper terminals 32. The fastening plate 511 is disposed on a top surface of the upper base portion 311. The two lateral plates 513 are respectively fastened to two opposite sides of the lower base portion 211 and two opposite sides of the upper base portion 311. The two lateral plates 513 of the main shell 51 are respectively soldered with the two first fixing arms 523. The circuit board 200 defines a plurality of insertion holes 201 distributed in the circuit board 200. The two insertion feet 514 are inserted into the insertion holes 201 and soldered to the circuit board 200. The connecting slice 515 is attached to a front surface of the upper base portion 311. The lower terminal module 20, the upper terminal module 30 and the insulation module 40 are received in the receiving space 516 of the shielding shell 50. The front end of the shielding shell 50 surrounds the dielectric body 411. The front end of the shielding shell 50 is spaced from the butting portion 412 and the tongue board 42 to form the insertion space 62 among the front end of the shielding shell 50, the butting portion 412 and the tongue board 42. The second fixing plate 531 is fastened to a rear end of a bottom surface of the bottom plate 5162 of the main shell 51. The two second fixing arms 532 are respectively fastened to rears of outer surfaces of the two connecting plates 5163. The propping plate 533 is disposed under the lower insulating housing 21, the rear ends of the upper terminals 32, the rear ends of the lower terminals 22 and the circuit board 200. The propping plate 533 is disposed under the lower base portion 211, the upper soldering portion 323 of each of the upper terminals 32, the lower soldering portion 223 of each of the lower terminals 22 and the circuit board 200. The soldering feet 534 are soldered to a bottom surface of the circuit board 200.

The outer shell 54 is mounted outside and seals up a front end of the main shell 51. Specifically, the first locating plate 5411 is fastened to the bottom surface of the bottom plate 5162. The two first protruding portions 5413 respectively project into the insertion space 62 through the two lower fastening holes 5165. The two first holding plates 5414 are respectively fastened to lower portions of the outer surfaces of the two connecting plates 5163. The two first insertion slices 5416 are inserted into the insertion holes 201 and soldered to the circuit board 200. The two propping pieces 5166 respectively pass through the two buckling holes 5417 of the two connecting arms 5415 to be mounted on the top surface of the circuit board 200. The second locating plate 5421 is mounted to a top surface of the top plate 5161 of the main shell 51. The two second protruding portions 5423 respectively project into the insertion space 62 through the two upper fastening holes 5164. The two second holding plates 5424 are respectively disposed to upper portions of the outer surfaces of the two connecting plates 5163. The two soldering slices 5425 are respectively soldered to outer surfaces of the two first holding plates 5414. The two sealing pieces 5426 are respectively received in and seal up the two notches 512. The two third holding plates 5427 are respectively fastened to outer surfaces of the two lateral plates 513 of the main shell 51. The second insertion slices 5428 are inserted into the insertion holes 201 and soldered to the circuit board 200.

As described above, the lower connecting piece 231 of each of the lower ground terminals 23 contacts with the bottom surface of the middle shielding plate 10, and the upper connecting piece 331 of each of the upper ground terminals 33 contacts with the top surface of the middle shielding plate 10, electromagnetic interferences will be effectively eliminated between the lower terminals 22 and the upper terminals 32 to improve signal transmission qualities of the lower terminals 22 and the upper terminals 32. In addition, the outer shell 54 is mounted outside and seals up the front end of the main shell 51, the propping plate 533 of the bottom shell 53 is disposed under the lower base portion 211 of the lower insulating housing 21, the upper soldering portion 323 of each of the upper terminals 32 and the lower soldering portion 223 of each of the lower terminals 22, so the lower terminals 22 and the upper terminals 32 are surrounded by the shielding shell 50 to effectively avoid external electromagnetic interferences, so that the signal transmission qualities of the lower terminals 22 and the upper terminals 32 are further improved.

What is claimed is:

1. An electrical connector mounted to a circuit board, comprising:

a middle shielding plate having a restricting plate and a soldering arm connected with the restricting plate, the soldering arm being soldered on a top surface of the circuit board;

a lower terminal module, the middle shielding plate being mounted on the lower terminal module, the lower terminal module including:

a lower insulating housing; and a plurality of lower terminals fixed to the lower insulating housing and transversely arranged at intervals, front ends of the lower terminals projecting beyond a front surface of the lower insulating housing, rear ends of the lower terminals projecting beyond a bottom surface of the lower insulating housing and soldered on the top surface of the circuit board, the lower terminals including two lower ground terminals, a front end of an outer side of each of the lower ground terminals being connected with a lower connecting piece, the lower connecting piece contacting with a bottom surface of the middle shielding plate;

an upper terminal module mounted on a top surface of the middle shielding plate, the upper terminal module including:

an upper insulating housing; and a plurality of upper terminals fixed to the upper insulating housing and transversely arranged at intervals, front ends of the upper terminals projecting beyond a front surface of the upper insulating housing, rear ends of the upper terminals projecting beyond a bottom surface of the upper insulating housing and soldered on the top surface of the circuit board, the upper terminals including two upper ground terminals, a front end of an outer side of each of the upper ground terminals being connected with an upper connecting piece, the upper connecting piece contacting with a top surface of the middle shielding plate;

an insulation module, including:

a tongue board molded to front ends of the lower terminal module, the upper terminal module and the middle shielding plate, the front ends of the lower terminals being exposed to a bottom surface of the tongue board, the front ends of the upper terminals being exposed to a top surface of the tongue board; and a main body molded outside the tongue board, the middle shielding plate, the lower terminal module and the upper terminal module; and a shielding shell mounted outside the lower terminal module, the upper terminal module and the insulation module, an insertion space being formed between a front end of the shielding shell and the insulation module;

wherein each of the lower terminals has a lower fastening portion extending in a substantially vertical direction, a lower contact portion extended frontward from a bottom of the lower fastening portion, and a lower soldering portion extended rearward from a top of the lower fastening portion, the lower insulating housing has a lower base portion, the lower base portion defines a receiving opening penetrating through rear ends of a top surface, a bottom surface and a middle of a rear surface of the lower base portion, a front end of a bottom surface of the lower base portion extends downward to form a connecting board, a bottom of a front surface of the connecting board extends frontward to form an extending board, the lower fastening portion is fastened in the connecting board, a rear end of the lower contact portion is fastened in the extending board, a front end of the lower contact portion projects beyond a front surface of the extending board, a front end of the lower soldering portion is fastened to the bottom surface of the lower base portion, a tail end of the lower soldering portion projects into the receiving opening and is soldered on the top surface of the circuit board.

2. The electrical connector as claimed in claim 1, wherein the front ends of the outer side of each of the lower ground terminals extends upward and then extends outward to form the lower connecting piece, the front end of the outer side of each of the upper ground terminals extends downward and then extends outward to form the upper connecting piece.

3. The electrical connector as claimed in claim 1, wherein the middle shielding plate has a restricting plate, and an abutting plate bent downward from a rear end of the restricting plate, a front end of the restricting plate is bent downward to form a front plate, a bottom end of the front plate is bent frontward and further extends frontward to form a tongue plate, a front end of a top surface of the lower base portion is recessed downward to form an assembling opening communicated with the receiving opening, a front end of the restricting plate is assembled in the assembling opening, a rear end of the restricting plate is located above the receiving opening, the abutting plate projects into the receiving opening, the front plate abuts against the front surface of the connecting board, a rear end of the tongue plate is disposed above the extending board.

4. The electrical connector as claimed in claim 3, wherein each of the upper terminals has an inverted U-shaped upper fastening portion, an upper contact portion extended frontward from a bottom of a front end of the upper fastening portion, and an upper soldering portion extended rearward from a bottom of a rear end of the upper fastening portion, the upper insulating housing has an upper base portion, a rear end of a bottom surface of the upper base portion protrudes downward to form an upper protruding board, a front end of the bottom surface of the upper base portion protrudes downward to form an upper fastening board, the upper fastening portion is fastened in the upper base portion, the upper protruding board and the upper fastening board, the upper contact portion projects beyond a bottom of a front surface of the upper fastening board, the upper soldering portion projects beyond a bottom surface of the upper protruding board, the upper base portion is fastened on top surfaces of the lower base portion and the restricting plate, the upper protruding board projects into the receiving opening, a front surface of the upper protruding board is located behind a rear surface of the abutting plate, the upper soldering portion is received in a bottom of a rear of the receiving opening and is soldered on the top surface of the circuit board, a rear surface of the upper fastening board abuts against a front surface of the front plate.

5. The electrical connector as claimed in claim 4, wherein a front end of an outer side of the lower contact portion of each of the lower ground terminals extends upward and then extends outward to form the lower connecting piece, the lower connecting piece contacts with a bottom surface of the tongue plate, a front end of an outer side of the upper contact portion of each of the upper ground terminals extends upward and then extends outward to form the upper connecting piece, the upper connecting piece contacts with a top surface of the tongue plate.

6. The electrical connector as claimed in claim 4, wherein two opposite sides of a rear surface of the upper base portion is flush with two opposite sides of the rear surface of the lower base portion, the front surface of the upper fastening board is flush with the front surface of the extending board.

7. The electrical connector as claimed in claim 4, wherein rear ends of two opposite sides of the restricting plate are bent downward and then are bent outward to form two soldering arms, the lower base portion defines two assembling holes respectively penetrating through two opposite sides of the top surface and two opposite sides of the bottom surface of the lower base portion, the two soldering arms are fastened to the two assembling holes and project beyond the bottom surface of the lower base portion, the two soldering arms are soldered on the top surface of the circuit board.

8. The electrical connector as claimed in claim 4, wherein the tongue board is molded to the lower contact portion of each of the lower terminals, the upper contact portion of each of the upper terminals and a front end of the tongue plate, two opposite side surfaces of the front end of the tongue plate are exposed to two opposite side surfaces of the tongue board, the lower contact portion is exposed to the bottom surface of the tongue board, the upper contact portion is exposed to the top surface of the tongue board.

9. The electrical connector as claimed in claim 4, wherein the main body has a dielectric body, and a butting portion protruded frontward from a middle of a front surface of the dielectric body, the dielectric body is molded outside the upper fastening board, the connecting board and the extending board, a rear surface of the connecting board is flush with a rear surface of the main body, the insulation module further includes a metal shell, the metal shell is fastened to a rear end of the tongue board, the butting portion is molded outside the rear end of the tongue board and the metal shell.

10. The electrical connector as claimed in claim 9, wherein the metal shell includes an upper shell and a lower shell, the upper shell has an upper base plate, and two upper side plates bent downward from two opposite sides of the upper base plate, the lower shell has a lower base plate, two lower side plates bent upward from two opposite sides of the lower base plate, several portions of a rear end of a bottom surface of the tongue board protrude downward to form a plurality of spaced lower protruding blocks arranged transversely, several portions of a rear end of a top surface of the tongue board protrude upward to form a plurality of spaced upper protruding blocks arranged transversely, two opposite sides of a rear end of the tongue board are recessed inward to form two fastening grooves, the upper base plate is disposed on top surfaces of the upper protruding blocks, the two upper side plates are respectively fastened in the two fastening grooves, the lower base plate is disposed at bottom surfaces of the lower protruding blocks, the two lower side plates are respectively soldered to outer surfaces of the two upper side plates.

11. The electrical connector as claimed in claim 10, wherein the upper shell has an upper rear plate bent upward from a rear end of the upper base plate, the lower shell has a lower rear plate bent downward from a rear end of the lower base plate, and an embedding plate extended rearward from a bottom edge of the lower rear plate, a bottom surface of the lower base plate is flush with and exposed to a bottom surface of the butting portion, a front surface of the lower rear plate is flush with the front surface of the dielectric body and exposed to a lower portion of the front surface of the dielectric body, a bottom surface of the embedding plate is flush with and exposed to a bottom surface of the dielectric body, a top surface of the upper base plate is flush with and exposed to a top surface of the butting portion, a front surface of the upper rear plate is flush with the front surface of the dielectric body and exposed to an upper portion of the front surface of the dielectric body.

12. The electrical connector as claimed in claim 11, wherein the shielding shell includes a main shell, a bottom shell and an outer shell, the main shell has a bottom plate, two connecting plates bent upward from two opposite sides of the bottom plate, a top plate connected between fronts of top edges of the two connecting plates, and a receiving space formed among the top plate, the bottom plate and the connecting plates, the lower terminal module, the upper terminal module and the insulation module are received in the receiving space, the outer shell is mounted outside and seals up a front end of the main shell, the bottom shell has a second fixing plate, a rear end of the second fixing plate is bent upward and then bent rearward to form a propping plate, two opposite sides of a rear edge of the propping plate extend rearward to form two soldering feet, the propping plate is disposed under the lower insulating housing, the rear ends of the upper terminals, the rear ends of the lower terminals and the circuit board, the soldering feet are soldered to a bottom surface of the circuit board.

13. The electrical connector as claimed in claim 12, wherein a middle of a rear edge of the top plate of the main shell is bent upward to form a connecting slice, a top edge of the connecting slice extends rearward and then spreads outward to form a fastening plate which has a longitudinal plate connected with the top edge of the connecting slice, and a transverse plate, a middle of a front edge of the transverse plate is connected with a rear edge of the longitudinal plate, two opposite sides of the front edge of the transverse plate are recessed rearward to form two notches, two opposite sides of the transverse plate are bent downward to form two lateral plates, rears of bottom edges of the two lateral plates protrude downward to form two insertion feet, the fastening plate is disposed on a top surface of the upper base portion, the two lateral plates are respectively fastened to two opposite sides of the lower base portion and two opposite sides of the upper base portion, the circuit board defines a plurality of insertion holes, the insertion feet are inserted into the insertion holes and soldered to the circuit board, the connecting slice is attached to a front surface of the upper base portion, the front end of the shielding shell surrounds the dielectric body, the front end of the shielding shell is spaced from the butting portion and the tongue board to form an insertion space among the front end of the shielding shell, the butting portion and the tongue board.

14. The electrical connector as claimed in claim 13, wherein the shielding shell includes a rear shell which has a blocking plate, a middle of a top edge of the blocking plate is bent frontward to form a first fixing plate, two opposite sides of the blocking plate are bent frontward to form two first fixing arms, upper portions of two opposite side surfaces of the lower base portion are recessed inward to form two first recesses, bottoms of two opposite side surfaces of the upper base portion are recessed inward to form two second recesses, the two first recesses are respectively corresponding to and cooperate with the two second recesses to form two fixing grooves, the blocking plate is disposed behind the upper base portion and the lower base portion, the first fixing arms are fixed in the fixing grooves, the two lateral plates of the main shell are respectively soldered with the two first fixing arms, the first fixing plate is received in a rear of receiving opening and is located above the upper soldering portion of each of the upper terminals.

15. The electrical connector as claimed in claim 13, wherein two opposite sides of a front end of the second fixing plate of the bottom shell are bent upward to form two second fixing arms, the second fixing plate is fastened to a rear end of a bottom surface of the bottom plate of the main shell, the two second fixing arms are respectively fastened to rears of outer surfaces of the two connecting plates, the propping plate is disposed under the lower base portion, the upper soldering portion of each of the upper terminals, the lower soldering portion of each of the lower terminals.

16. The electrical connector as claimed in claim 13, wherein the bottom plate of the main shell defines at least two lower fastening holes, the outer shell includes a first outer shell which has a first locating plate, the first locating plate defines at least two first gaps penetrating through a front surface of the first locating plate, rear walls of the two first gaps extend frontward to form two first elastic portions, free ends of the two first elastic portions are punched upward to form two first protruding portions, two opposite sides of the first locating plate are bent upward to form two first holding plates, top ends of the first holding plates define two second gaps, bottom walls of the two second gaps extend upward and then are bent outward to form two connecting arms, rears of outer sides of the two connecting arms are bent downward to form two first insertion slices, the first locating plate is fastened to a bottom surface of the bottom plate, the two first protruding portions respectively project into the insertion space through the two lower fastening holes, the two first holding plates are respectively fastened to lower portions of outer surfaces of the two connecting plates, the two first insertion slices are inserted into the insertion holes and soldered to the circuit board.

17. The electrical connector as claimed in claim 16, wherein the top plate of the main shell defines at least two upper fastening holes, the outer shell includes a second outer shell, the second outer shell has a second locating plate, the second locating plate defines at least two third gaps penetrating through a front surface of the second locating plate, rear walls of the two third gaps extend frontward to form two second elastic portions, free ends of the two second elastic portions are punched downward to form two second protruding portions, two opposite sides of the second locating plate are bent downward to form two second holding plates, fronts of bottom edges of the two second holding plates protrude downward to form two soldering slices, two opposite sides of a rear edge of the second locating plate are bent upward and then extend rearward to form two sealing pieces, two outer sides of the two sealing pieces are bent downward to form two third holding plates, rears of bottom edges of the two third holding plates are bent outward and then are bent downward to form two second insertion slices, the second locating plate is mounted to a top surface of the top plate of the main shell, the two second protruding portions respectively project into the insertion space through the two upper fastening holes, the two second holding plates are respectively disposed to upper portions of the outer surfaces of the two connecting plates, the two soldering slices are respectively soldered to outer surfaces of the two first holding plates, the two sealing pieces are respectively received in and seal up the two notches, the two third holding plates are respectively fastened to outer surfaces of the two lateral plates of the main shell, the second insertion slices are inserted into the insertion holes and soldered to the circuit board.

18. The electrical connector as claimed in claim 16, wherein the two connecting plates of the main shell are punched outward to form two propping pieces, the two connecting arms of the first outer shell define two buckling holes, the two propping pieces respectively pass through the two buckling holes to be mounted on the top surface of the circuit board.

* * * * *